US005476175A

United States Patent [19]

Jaszai

[11] Patent Number: 5,476,175

[45] Date of Patent: Dec. 19, 1995

[54] IMPACT-RESISTANT WRAPPING SYSTEM

[75] Inventor: Zoltan K. Jaszai, Tokyo, Japan

[73] Assignee: Burlington Consolidated Limited Incorporation, Dublin, Ireland; a part interest

[21] Appl. No.: 251,949

[22] Filed: Jun. 1, 1994

[30] Foreign Application Priority Data

Jun. 1, 1993 [JP] Japan ..... 5-130795

[51] Int. Cl.[6] ..... B65D 81/02

[52] U.S. Cl. ..... 206/522; 206/219

[58] Field of Search ..... 206/213.1, 219, 206/522, 523; 383/3

[56] References Cited

U.S. PATENT DOCUMENTS

| | | | |
|---|---|---|---|
| 2,118,165 | 5/1938 | Christopher et al. | 206/522 |
| 3,096,148 | 7/1963 | Walker, Jr. | 206/213.1 |
| 3,412,521 | 11/1968 | Bauman . | |
| 4,155,453 | 5/1979 | Ono . | |
| 4,193,499 | 3/1980 | Lookholder . | |
| 4,262,801 | 4/1981 | Avery . | |
| 4,295,566 | 10/1981 | Vincek . | |
| 4,620,633 | 11/1986 | Lookholder . | |
| 4,653,643 | 3/1987 | Black | 206/522 |
| 4,905,835 | 3/1990 | Pivert et al. | 206/522 |
| 4,924,899 | 5/1990 | Po . | |
| 5,009,318 | 4/1991 | Lepinoy . | |
| 5,042,663 | 8/1991 | Heinrich . | |
| 5,129,519 | 7/1992 | David et al. . | |

FOREIGN PATENT DOCUMENTS

| | | | |
|---|---|---|---|
| 0170229 | 2/1986 | European Pat. Off. . | |
| 0434447 | 6/1991 | European Pat. Off. . | |
| 2277006 | 1/1976 | France | 206/522 |
| 8811162 | 12/1988 | Germany . | |
| 4103139 | 8/1992 | Germany . | |
| 51-93720 | 7/1976 | Japan . | |
| 54-136985 | 10/1979 | Japan . | |
| 2184997 | 7/1987 | United Kingdom . | |
| 2230509 | 10/1990 | United Kingdom . | |
| 87/02012 | 4/1987 | WIPO . | |

*Primary Examiner*—David T. Fidei
*Attorney, Agent, or Firm*—Wenderoth, Lind & Ponack

[57] ABSTRACT

An impact-resistant wrapping system includes a sheetlike wrapping body having a cavity surrounded by a flexible wall member with gas-barrier properties and a gas-generating capsule having at least two types of materials for generating a gas to expand the cavity of the sheetlike wrapping body. The materials are separately sealed by a film and can be mixed with each other upon being depressed. A portion permeable only to the gas is formed in at least a part of the gas-generating capsule, while the gas-generating capsule is accommodated in the cavity of the sheetlike wrapping body.

11 Claims, 11 Drawing Sheets

IMPACT-RESISTANT WRAPPING SYSTEM

BACKGROUND OF THE INVENTION

The present invention relates to an impact resistant wrapping system and, more particularly, to improvements in the versatility and handling properties of an impact resistant wrapping system in which an impact resistant space capable of expanding or being inflated with a gas is formed around an article to be wrapped.

For example, a conventional impact resistant wrapping system described in Japanese Unexamined Patent Application Public Disclosure No. SHO 54-136985 is known and describes an impact resistant wrapping system for forming an impact resistant space expanding with a gas. In this prior art system, a sealed annular chamber of a double structure is made of a synthetic resin film having gas barrier properties inside a cylindrical shape. In this impact resistant wrapping system, after an article to be wrapped is inserted into the sealed annular chamber, air is injected into the sealed annular chamber to form an impact resistant space constituted by the expanded and sealed annular chamber around the article.

In this prior art system, the article must be inserted inside the sealed annular chamber. For this reason, this wrapping system can be applied only to articles having a cylindrical (e.g., a circular cylinder) or columnar shape or a shape equivalent thereto, and it lacks versatility.

Also in Japanese Patent-Application publication No. SHO 63-502099 (corresp. to International Application No. PCT/US86/01989), a protective envelope for containing a fragile article is proposed in which an elastic cushion material is stuffed in a compressed flat state in between airtight membranes that are folded double and which constitute a protective envelope.

This prior art protective envelope cannot cope with a variety of articles that are different in shape. This is because the envelope has a definite shape which is defined by basically sealing the envelope along the lateal edges and bottom edges of the membranes so as to form an upper opening. Thus, this protective envelope cannot be reused nor applied to articles having various shapes, and it has limitations due to its capacity for wrapping an article.

Furthermore, under U.S. Ser. No. 08/113,660, a wrapping system is proposed for protecting various fragile articles from shock, in which inflatable cushion material is stuffed in a flat state and expands to enhance the cushioning effect when wrapping an article.

This prior art wrapping system cannot have adequate handling properties. This is because the system has a structure effecting air injection by cutting an outer membrane in order to form an impact-resistant space. Thus cumbersome operations such as air injection, are required, resulting in inadequate handling.

OBJECT OF THE INVENTION

The present invention has been made in consideration of the drawbacks described above, and its object is to provide a highly versatile, impact-resistant wrapping system having excellent handling properties and capable of wrapping articles having a variety of shapes and sizes by means of simple operations.

SUMMARY OF THE INVENTION

In order to achieve the above object of the present invention, an impact-resistant wrapping system is provided comprising a sheetlike wrapping body having a cavity surrounded by a flexible wall member with gas-barrier properties and a gas-generating capsule in which at least two types of materials for generating a gas, needed to inflate the cavity of the sheetlike wrapping body upon being mixed with each other, are separately sealed. The materials can be mixed with each other upon being pressed and wherein a portion permeable only to the gas is formed in at least a part of the gas-generating capsule, while the gas-generating capsule is accommodated in the cavity of the sheetlike wrapping body.

This wrapping system has a flexible sheetlike wrapping body deformable to any shape conforming to the shape of any article to be wrapped. For this reason, the wrapping system can wrap articles having different shapes and sizes. Upon depression of the gas-generating capsule accommodated inside the sheetlike wrapping body, the cavity of the sheetlike wrapping body is filled with the gas, thereby forming an expanded impact resistant space.

Therefore, a highly versatile, impact-resistant wrapping system is provided, having excellent handling properties and capable of wrapping articles having a variety of a shapes and sizes by means of simple operation.

As described above, the impact-resistant wrapping system according to the present invention has a deformable, flexible, sheetlike wrapping body, and the cavity of the sheetlike wrapping body can be filled with the gas to form the expanded impact-resistant space upon depressing only the gas-generating capsule. For these reasons, articles having a variety of shapes and sizes can be wrapped by means of a simple operation, thereby providing a highly versatile, easy-to-handle wrapping system.

The impact-resistant wrapping system is characterized in that the inner surfaces of the flexible wall member of the sheetlike wrapping body, on which inner surfaces oppose each other via the cavity, are partially adhered.

Abnormal expansion of a part of the impact-resistant space can be prevented by partial adhesion of the cavity of the sheetlike wrapping body.

The impact-resistant wrapping function around the article can be made uniform, because abnormal expansion of a part of the impact-resistant space can be prevented by partial adhesion of the cavity of the sheetlike wrapping body.

The impact-resistant wrapping system is characterized in that the cavity of the sheetlike wrapping body is partitioned into a plurality of compartments, and that the gas-generating capsule is accommodated in each of the compartments.

An impact-resistant space to be expanded is partitioned or selected by partitioning the cavity of the sheetlike wrapping body.

The impact-resistant space of a necessary compartment only, which is required for the impact-resistant wrapping of an article, is formed to obtain a suitable impact-resistant wrapping form of the article, because an impact resistant space to be expanded is partitioned or selected by partitioning the cavity of the sheetlike wrapping body. At the same time, even if the gas leaks, this leakage is limited to a specific compartment or compartments. Therefore, the impact-resistant space of the entire sheetlike wrapping body will not be lost.

The impact-resistant wrapping system is characterized the cavity of the sheetlike wrapping body being defined by a plurality of cavity layers stacked on each other and that the gas-generating capsule is accommodated in each one of the stacked layers.

An impact-resistant space to be expanded is stacked or selected by stacking the cavity layers in the sheetlike wrapping body.

As described above, an impact resistant space to be expanded is stacked or selected by stacking the cavity layers in the sheetlike wrapping body, so that the impact-resistant space is formed in a portion which requires protection of the article, thereby obtaining an appropriate form of the impact-resistant wrapping function for the article. In addition, the impact-resistant wrapping function can be improved by the stacked impact-resistant spaces. In addition, if each layer of an impact-resistant space is formed at a time, the wrapping system can be repeatedly used a number of times corresponding to the number of stacked spaces, without requiring reinjection of the gas, air or the like.

The impact-resistant wrapping system is characterized by comprising connecting means, mounted on an outer surface of a flexible wall member, to hold the sheetlike wrapping body in an appropriate shape.

The connecting means can hold the wrapped state of the article in the sheetlike wrapping body.

The article can be easily wrapped, because the connecting means can hold the wrapped state of the article in the sheetlike wrapping body.

The impact-resistant wrapping system is characterized by comprising an elastic impact-resistant material which is compressed and accommodated in the cavity of the sheetlike wrapping body.

The elastic impact resistant material expands and is filled into the expanded impact resistant space.

Even if a gas leaks, a considerably sufficient impact resistant space can be retained by the elastic impact-resistant material, because the elastic impact-resistant material expands and is filled into the expanded impact-resistant space.

The impact-resistant wrapping air system is characterized by comprising an exhaust valve, which is mounted in such a way as to communicate with the cavity of the sheetlike wrapping body, to exhaust the gas outside the cavity.

When the exhaust-gas valve is opened to exhaust the gas, the gas, which has expanded the impact-resistant space, is released outside the cavity of the sheetlike wrapping body, while the impact-resistant space contracts.

The gas, which has expanded the impact-resistant space, can be exhausted outside the cavity of the sheetlike wrapping body upon opening the exhaust-air valve, so that the impact-resistant space shrinks to allow for easy unwrapping of the article.

The impact-resistant wrapping system is characterized by the exhaust-air valve having a structure capable of reinjecting a gas, air or the like again into the cavity of the sheetlike wrapping body and capable of sealing the cavity.

The shrunken impact-resistant space can be expanded again by reinjecting and sealing a gas, air or the like through the exhaust-air valve.

The impact-resistant wrapping system can be used again because the shrunken impact-resistant space can be expanded again by reinjecting and sealing the gas, air or the like from the portion, except for the gas-generating capsule through the exhaust-air valve.

Other and further objects of the present invention will become obvious upon understanding the illustrative embodiments about to be described or will be indicated in the appended claims, while various advantages not referred to herein will occur to one who is skilled in the art upon putting the invention into practice.

BRIEF DESCRIPTION OF THE DRAWINGS

The objects and features of the present invention will be hereinafter explained in detail with reference to the accompanying drawings, in which.

DESCRIPTION OF THE PREFERRED EMBODIMENTS

Impact-resistant wrapping systems according to the preferred embodiments of the present invention will be described with reference to the accompanying drawings.

FIGS. 1 to 12 show an impact-resistant wrapping system according to a first embodiment of the present invention.

Figure 1:
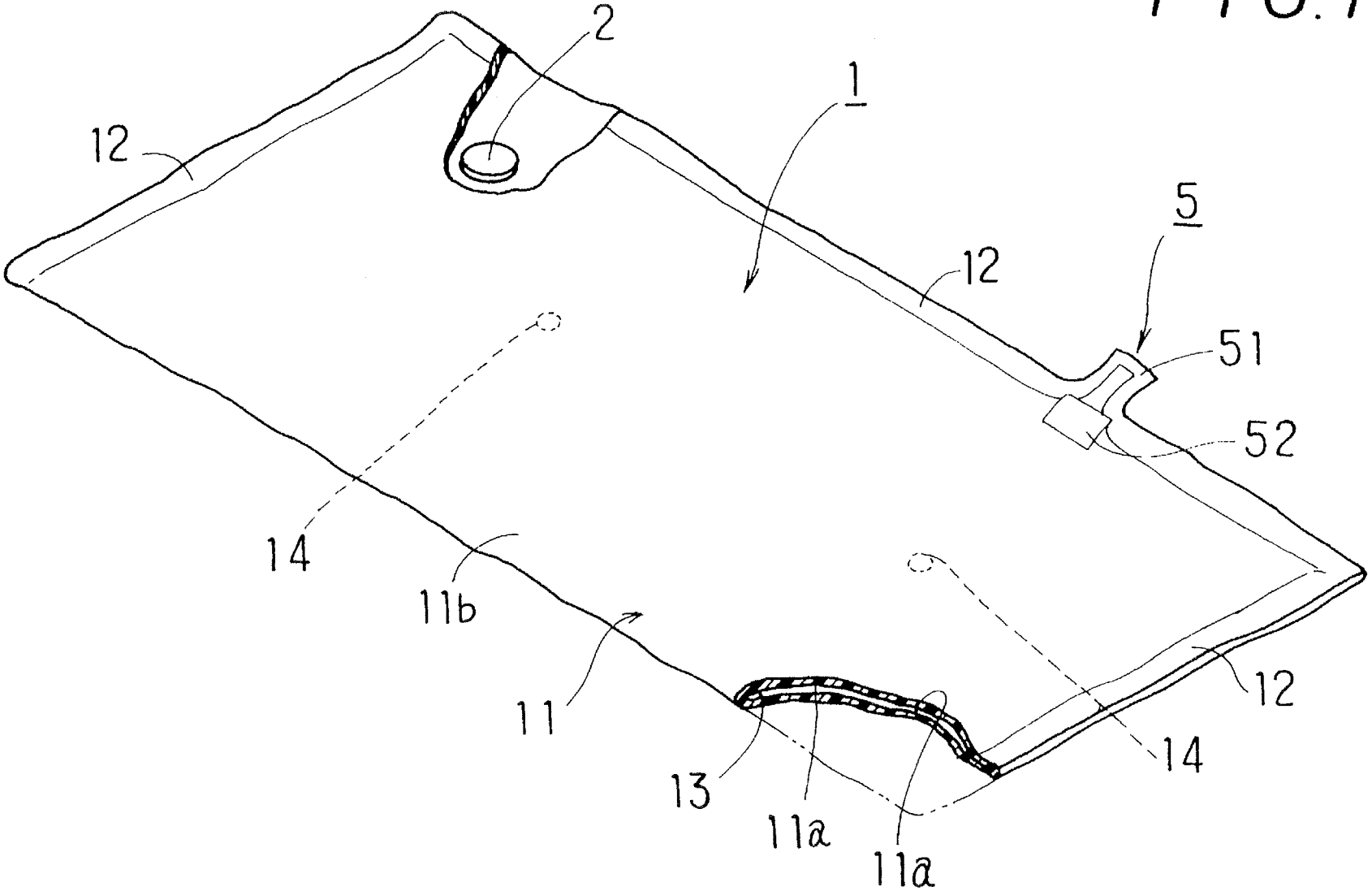
FIG. 1 is a partially cutaway perspective view showing an impact-resistant wrapping system according to the first embodiment of the present invention.
Figure 2:
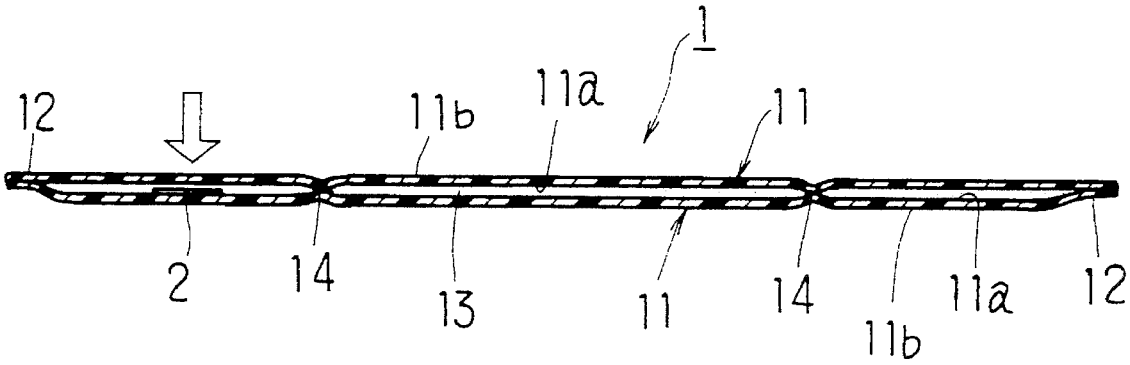
FIG. 2 is a sectional view of the system of FIG. 1.

As shown in FIGS. 1 and 2, a sheetlike wrapping body 1 is formed in such a way that a single flexible wall member 11 is folded, while three sides are adhered by adhesive application or thermal-solvent welding to constitute seal portions 12. The sheetlike wrapping body 1 has a cavity 13 defined by the flexible wall member 11. The flexible wall member 11 has gas-barrier properties which inhibit gas permeation, or it has a very low permeability, in other words the flexible wall member is substantially impermeable to gas. At the same time, the flexible wall member 11 has flexibility that allows deformation to conform the member 11 to the shape of an article P. The flexible wall member 11 consists of a single-layered synthetic-resin film, a multilayered synthetic-resin film, a laminated metal film or the like. In the formation of the seal portions 12, the cavity 13 is deaerated to bring opposing inner surfaces 11*a* of the flexible wall member 11 into tight contact with each other as much as possible, thereby minimizing the total thickness of the sheetlike wrapping body 1. Spot-welded portions 14 welded with an adhesive or the like are partially formed on the opposing inner surfaces 11*a* of the flexible wall member 11 in the deaerated state of the cavity 13.

A gas-generating capsule 2, capable of producing a gas G nontoxic to man, such as oxygen, nitrogen or carbon dioxide, is accommodated inside the cavity 13 of the sheetlike wrapping body 1.

Figure 4A:
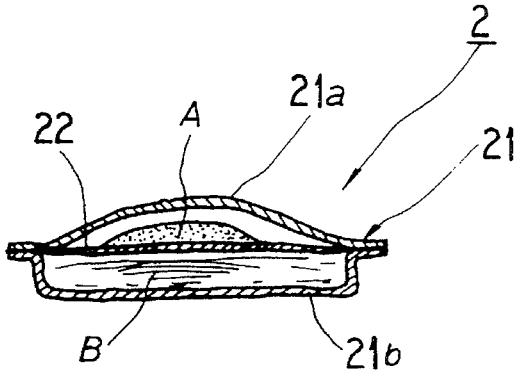
FIGS. 4A to 4C are sectional views showing operative states of a main part in FIGS. 2 and 3.
Figure 4B:
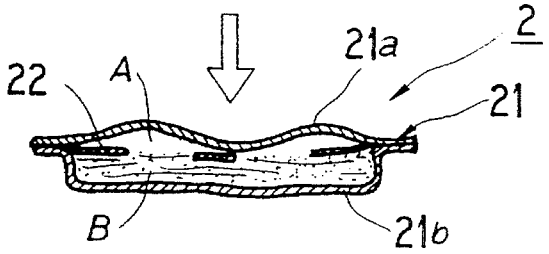
Figure 4C:
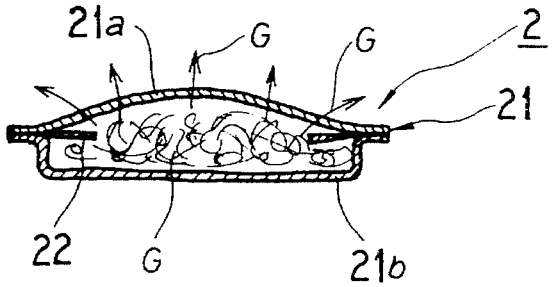

As shown in FIGS. 4A to 4C in detail, the gas-generating capsule 2 has a partition film 22 inside a vessel 21. In this gas-generating capsule 2, one material A consisting of a liquid or solid material is separated from the other material consisting of a liquid or solid material through the partition film 22. When the partition film 22 is destroyed, these materials A and B are mixed with each other to cause a chemical reaction, thereby generating the gas G which is used to inflate the cavity 13 of the sheetlike wrapping body 1. For example, if the gas G is oxygen, the material A consists of manganese dioxide, while the material B consists of an aqueous solution of hydrogen peroxide. A variety of solid materials, each obtained by bonding a water-soluble derivative to a gas as a material for chemical experiments, horticulture, or aquariums have become available recently. Such a material can be used as the material A, while water is used as the material B. Preferably, materials A and B, which do not chemically react with each other at a high temperature nor cause a chemical reaction to produce a gas which may damage the vessel 21, are selected. In the gas-generating capsule 2 shown in FIGS. 4A to 4C, a half 21*a* of the vessel 21, which is partitioned by the partition film 22, is made of a flexible material and it is depressed and deformed to eliminate the partition film 22. The other half 21*b* of the vessel 21 is made of a hard material so that the vessel 21 can withstand a depressive force or impact, while the vessel 21 itself will not be destroyed. The half 21*a* of the vessel 21 is made of a synthetic material having mazelike pores. The half 21*a* is permeable only to the gas G in order to prevent a liquid or the like from leaking outside the vessel 21.

Figure 3:
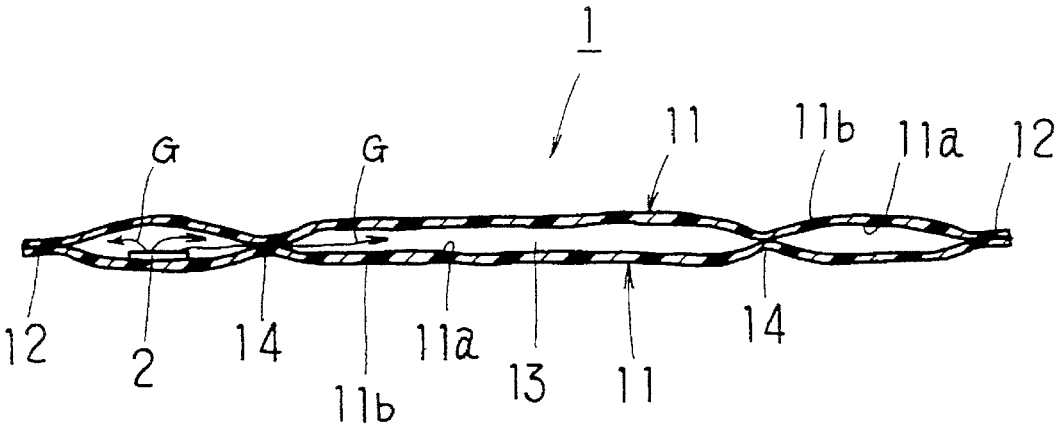
FIG. 3 is a sectional view showing an operative state of the system of FIG. 2.

The gas G, which permeated through the vessel 21, is filled into the cavity 13 of the sheetlike wrapping body 1 to expand the cavity 13 by cubical expension of the gas G, thereby forming an impact-resistant space (FIG. 3). At this time, the spot-welded portions 14 of the sheetlike wrapping body 1 prevent local abnormal expansion of the impact resistant space. For this reason, the impact-resistant wrapping function for the article P can be made uniform around the article P.

Figure 5:
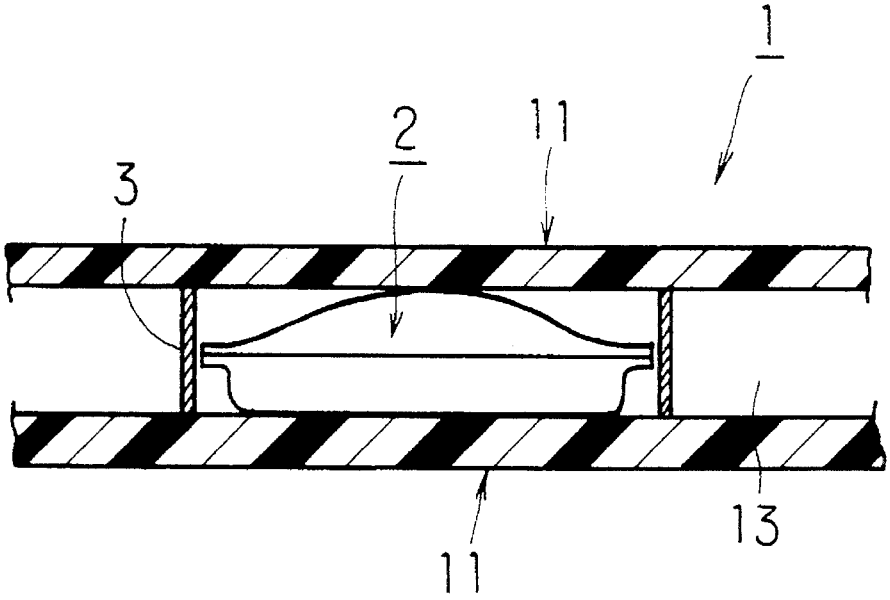
FIG. 5 is a sectional view showing wrapping structure of one main part (gas-generating capsule) as shown in FIGS. 4A to 4C.
Figure 6:
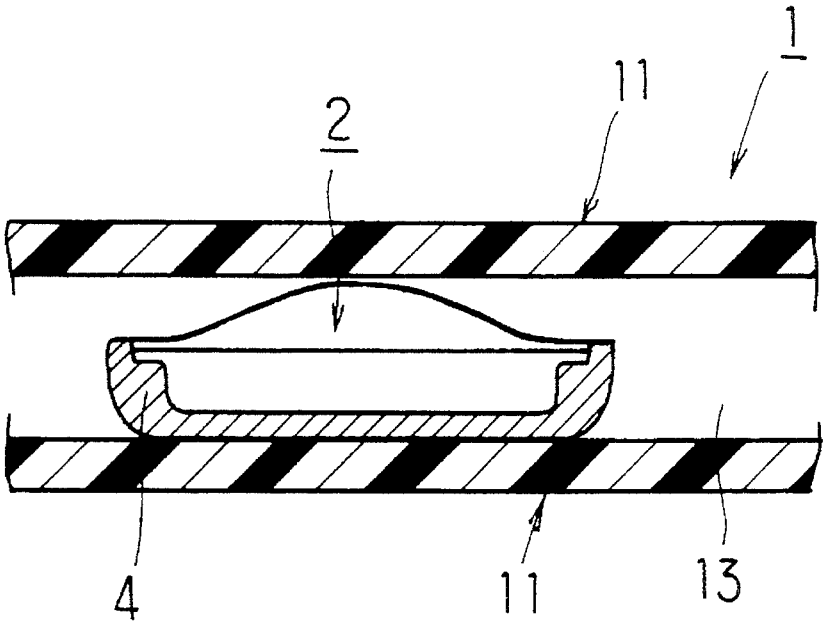
FIG. 6 is a sectional view showing a modification of the impact-resistant wrapping system of FIG. 5.

The gas-generating capsule 2 is preferably protected from accidental impact by a protective ring 3, as seen in FIG. 5, or a dishlike foamed resin material 4, as shown in FIG. 6.

In addition, an exhaust-air valve 5, which communicates with the cavity 13 and which is capable of exhausting the gas G outside the cavity 13, is mounted in the sheetlike wrapping body 1 of this embodiment.

Figure 7:
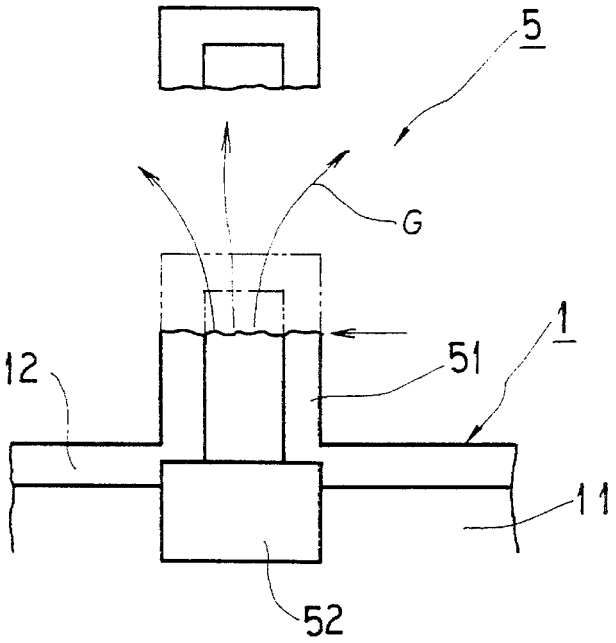
FIG. 7 is a plan view showing an applied state of another main part (exhaust-air valve) of FIG. 1.
Figure 8:
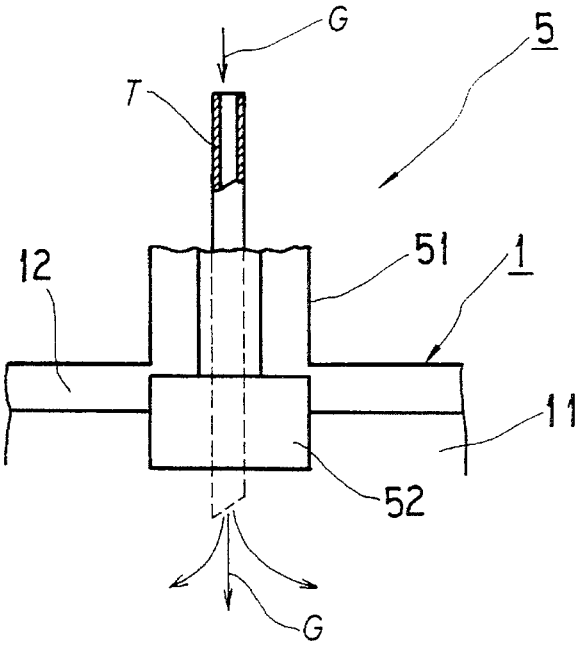
FIG. 8 is a plan view showing another applied state of the system of FIG. 7.
Figure 9:
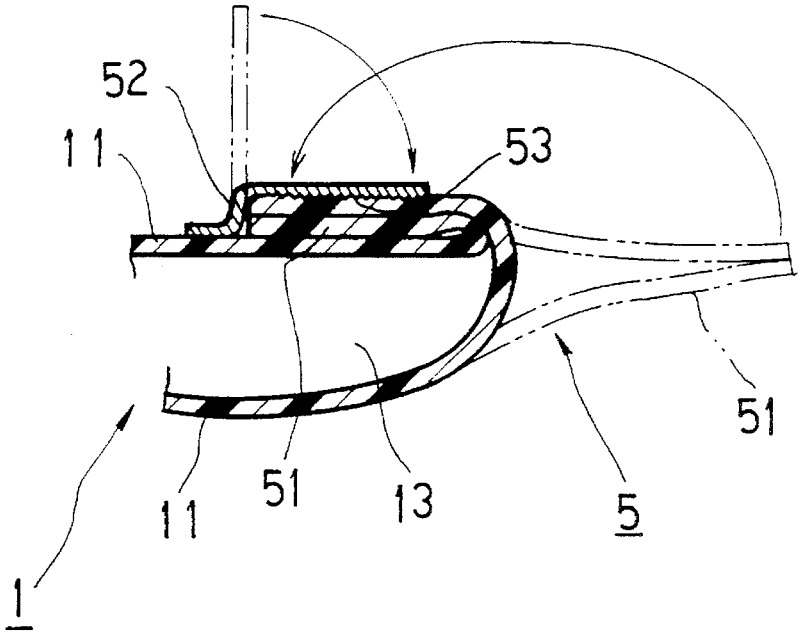
FIG. 9 is a sectional view showing a sealed state after the state of FIG. 8.

The exhaust-air valve 5 comprises a projecting piece 51 which slightly extends from one side of the sheetlike wrapping body 1, having an almost rectangular shape, and is obtained by extending the corresponding seal portion 12 along the edge of this side, while a seal piece 52 is partially fixed to an outer surface 11*b* of the flexible wall member 11 near the projecting piece 51 and a pressure-sensitive adhesive 53 is applied to a nonfixed surface of the seal piece 52 on the side of flexible wall member 11. As shown in FIG. 7, when the distal end portion of the projecting piece 51 is cut, the gas G, which has been filled into the cavity 13 of the sheetlike wrapping body 1, can be exhausted. As shown in FIG. 8, a tube T, such as a straw, is inserted from the cut end of the projecting piece 51 to allow the injection of gas or air into the cavity 13 of the sheetlike wrapping body 1. As shown in FIG. 9, after the gas G, air or the like is injected into the cavity 13 of the sheetlike wrapping body 1, the projecting piece 51 is folded toward the side of sheetlike wrapping body 1. The seal piece 52 is placed on the folded portion and adhered thereto by means of the pressure-sensitive adhesive 53. Then, the injected gas G, air or the like is sealed into the cavity 13 of the sheetlike wrapping body 1.

Figure 10:
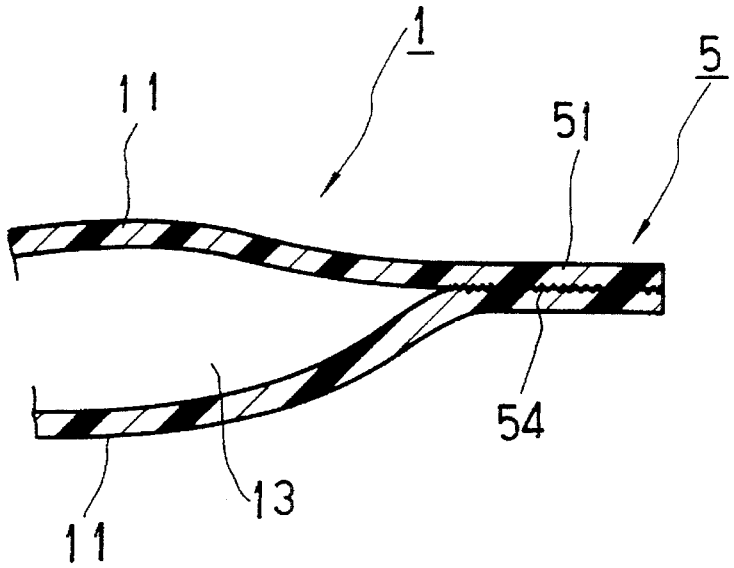
FIG. 10 is a sectional view showing a modification of FIGS. 7 to 9.

As shown in FIG. 10, an adhesive 54, which allows multiple adhesion or peeling, can be applied to the inner surface of the projecting piece 51 of the exhaust-air valve 5, thereby obtaining a simple structure.

Figure 11:
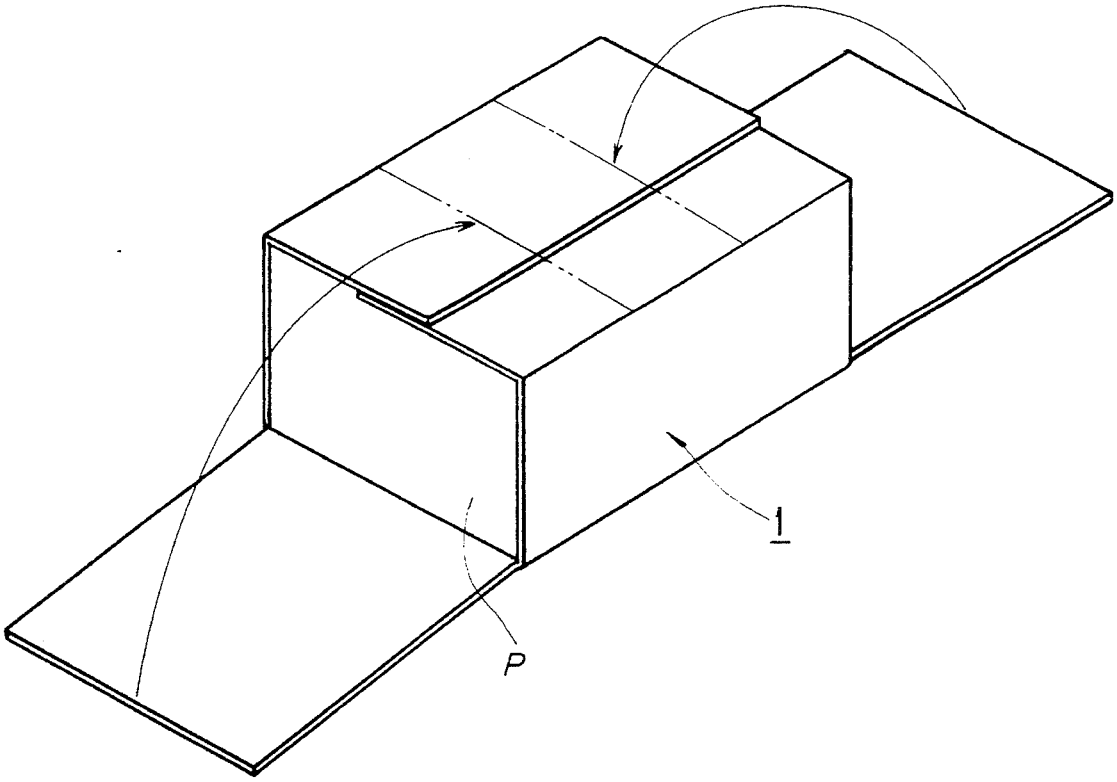
FIG. 11 is a perspective view showing an application of the impact resistant wrapping system shown in FIG. 1.
Figure 12:
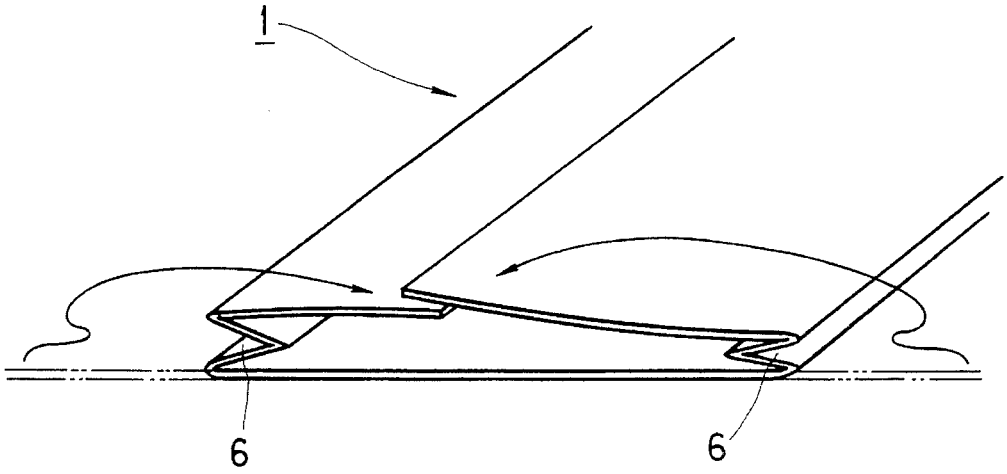
FIG. 12 is a perspective view showing another application different from that in FIG. 11.

According to this embodiment, a portion for wrapping the article P comprises a thin, sheetlike, flexible wrapping body having a deformable shape and material to conform to any shape. As shown in FIG. 11, the article P can be tightly wrapped, like using wrapping paper. As shown in FIG. 12, folded portions 6 may be partially formed to obtain a square envelope. In addition, articles P having a variety of shapes and sizes can be wrapped.

After the article P is wrapped (or before an article is wrapped, depending on the wrapping form), the gas-generating capsule, which is accommodated in the cavity 13 of the sheetlike wrapping body 1, needs only to be pressed in order to fill the cavity 13 of the sheetlike wrapping body 1 with the gas G, thereby forming the impact resistant space and hence wrapping the article P for purposes of impact resistance. Therefore, the article P can always be wrapped in a very simple operation.

When the impact-resistant space interferes with the unwrapping of the article P, the gas G is exhausted from the cavity 13 of the sheetlike wrapping body 1 through the exhaust-air valve 5, thereby eliminating the impact-resistant space.

After the article P is unwrapped, the wrapping system can be used again by injecting the gas G, air or the like through the exhaust-air valve 5.

Figure 13:
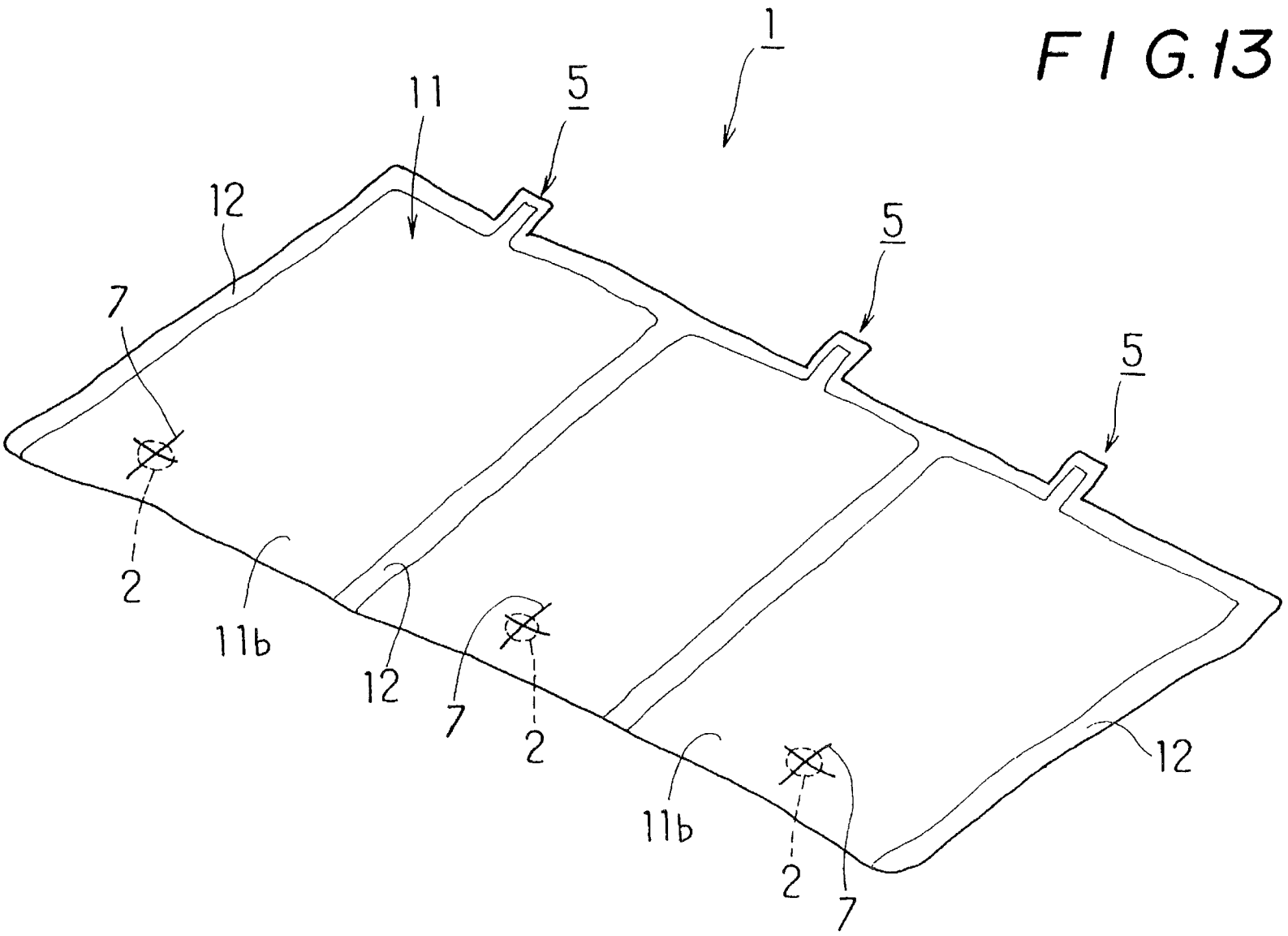
FIG. 13 is a perspective view showing an impact-resistant wrapping system according to a second embodiment of the present invention.

FIG. 13 shows an impact-resistant wrapping system according to a second embodiment of the present invention.

According to this embodiment, the seal portions 12 of the sheetlike wrapping body 1 of the first embodiment are extended to form three cavity Compartments 13. A gas-generating capsule 2 and an exhaust-air valve 5 are arranged in each cavity compartment 13. A mark 7 is formed on an outer surface 11b of a flexible wall member 11 in a position where the corresponding gas-generating capsule 2 is accommodated.

According to this embodiment, only a cavity compartment or compartments necessary for wrapping an article with impact resistance are selected, and a gas is produced from the gas-generating capsule or capsules 2 only in the selected cavity compartment or compartments, thereby obtaining a suitable impact-resistant wrapping form for the article P. Even if the flexible wall member 11 is damaged and leaks the gas G, this leakage is limited only to the corresponding cavity compartment, while the impact-resistant space of the entire sheetlike wrapping body 1 is not lost. In addition, since the gas-generating capsule 2 can be depressed when depressing it in the position of each mark 7, the position of the gas-generating capsule 2 can be easily found.

Figure 14:
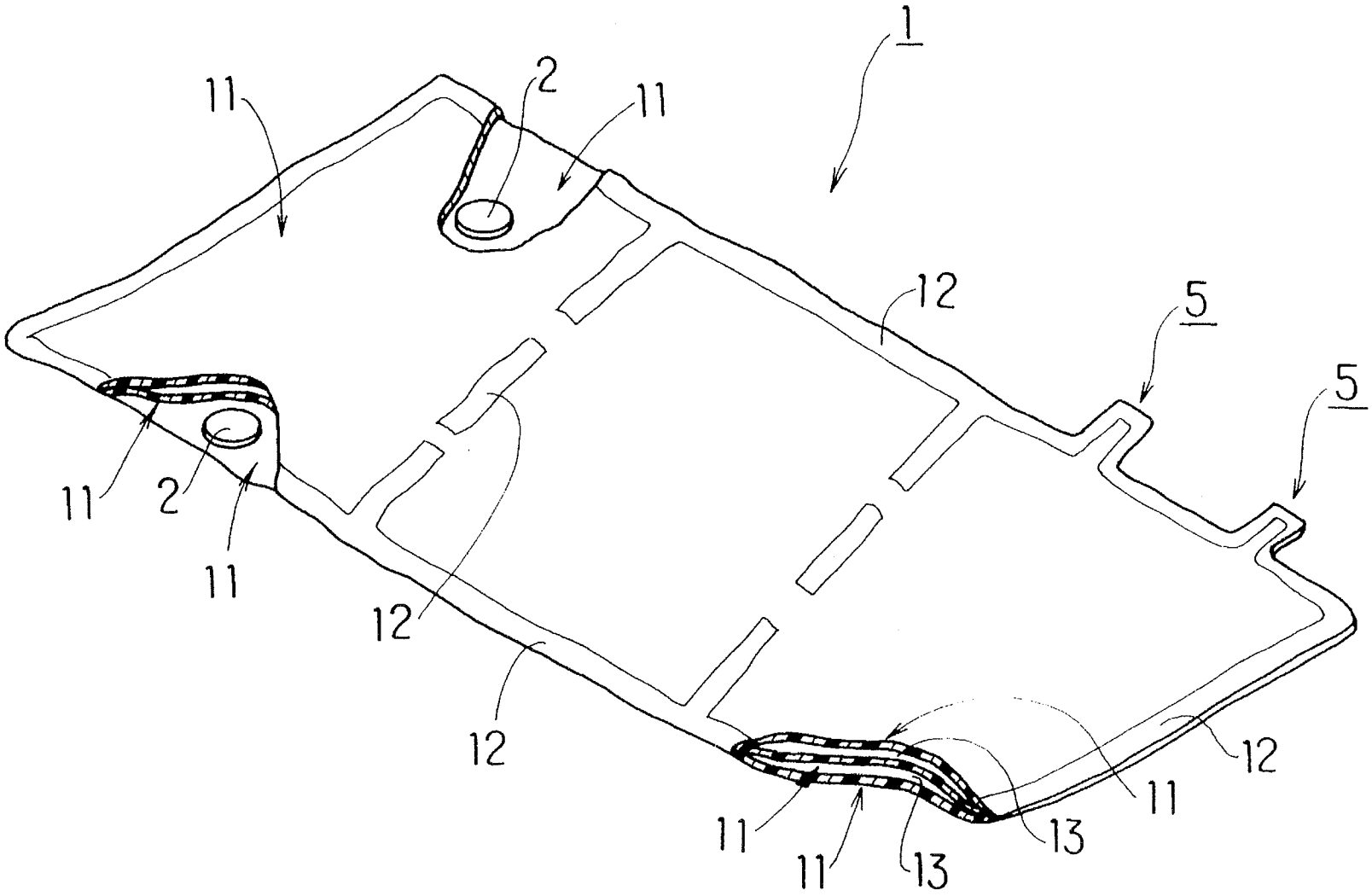
FIG. 14 is a partially cutaway, perspective view showing an impact-resistant wrapping system according to the third embodiment of a present invention.

FIG. 14 shows an impact-resistant wrapping system according to a third embodiment of the present invention.

In this embodiment, the flexible wall member 11 of the sheetlike wrapping body of the first embodiment comprises a three-layered structure, and seal portions 12 are formed at the four sides of a sheetlike wrapping body to stack two layers of cavity 13. A gas-generating capsule 2 and an exhaust-air valve 5 are arranged in each cavity layer 13. The seal portions 12 partially extend into the place previously having the spot-welded portion 14.

According to this embodiment, impact spaces having the two-layered structure are formed to improve impact-resistant wrapping. In addition, a gas is generated from the gas-generating capsule or capsules of a cavity layer or layers necessary for wrapping the article for purposes of impact resistance to obtain a suitable impact-resistant wrapping form for the article P. If the cavity layers are selectively expanded, the wrapping system can be used at least twice without injection of a gas G, air or the like.

This embodiment can be combined with the second embodiment.

Figure 15:
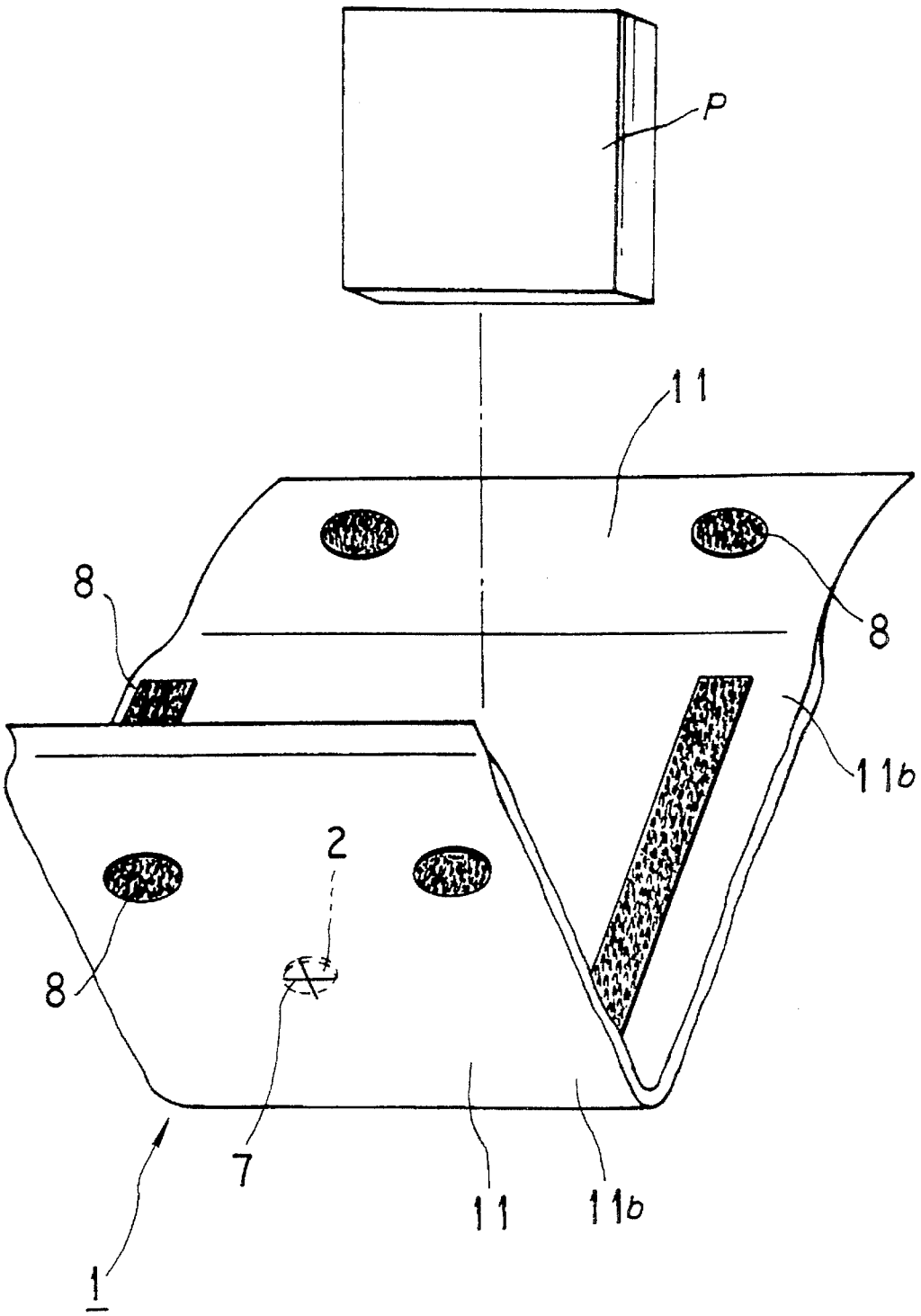
FIG. 15 is a perspective view showing an applied state of an impact-resistant wrapping system according to a fourth embodiment of the present invention.
Figure 16:
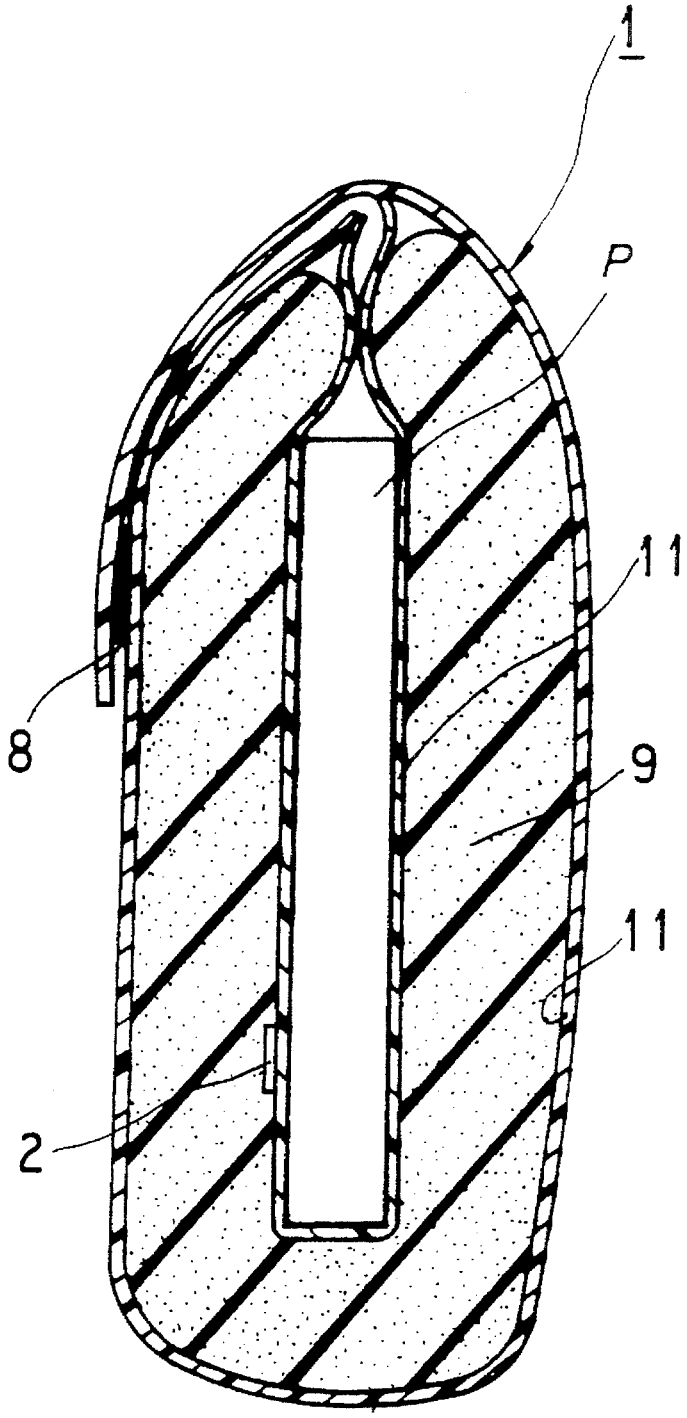
FIG. 16 is a sectional view showing a completely wrapped state of the system of in FIG. 15.

FIGS. 15 and 16 show an impact-resistant wrapping system according to a fourth embodiment of the present invention.

In this embodiment, connecting means 8 consisting of male and female velvet fasteners are attached to the outer surface of the flexible wall member 11 of the sheetlike wrapping body 1 of the first embodiment so as to make it possible to deform and fold the sheetlike wrapping body 1 into two. An elastic impact resistant material 9 is compressed and accommodated in a cavity 13 of a sheetlike wrapping body 1.

According to this embodiment, an article P can be easily wrapped, using the connecting means 8. Even if the flexible wall member 11 is damaged and leaks a gas G during wrapping, the impact-resistant space can be guaranteed to some extent by the elastic impact resistant material 9.

In addition to the illustrated embodiment described above, the connecting means 8 can be variously improved on and applied in the forms of a bag, a plaster cast, a paster bandage, soft flower wrapping and the like.

As many apparently widely different embodiments of the present invention may be made without departing from the spirit and scope thereof, it is to be understood that the invention is not limited to the specific embodiments thereof, except as defined in the appended claims.

What is claimed is:

1. An impact-resistant wrapping system, comprising:

a wrapping body comprising a flexible wall member that is substantially impermeable to gas and a cavity inside said flexible wall member; and a gas-generating capsule accommodated in said cavity of said wrapping body, said gas-generating capsule comprising at least two types of materials that are separately sealed therein and that are mixable with each other upon said gas-generating capsule being pressed, said at least two types of materials having the properties of generating a gas upon being mixed with each other, and said gas-generating capsule at least partly comprising a portion permeable to the gas generated by said two types of materials, whereby said cavity of said wrapping body can be inflated by the gas generated by pressing said gas-generating capsule so as to mix said at least two types of materials and the gas exiting said gas-generating capsule through said portion permeable to the gas.

2. The system of claim 1, wherein said flexible wall member has inner surfaces opposite to each other that are partially adhered to each other.

3. The system of claim 1, wherein said cavity in said wrapping body is partitioned into a plurality of separate compartments, and each of said compartments has a said gas-generating capsule disposed therein.

4. The system of claim 1, wherein said wrapping body further comprises a second cavity inside said flexible wall member, the first said cavity and said second cavity being layered such that said cavities are stacked on top of each other inside said flexible wall member, each of said cavities having a said gas-generating capsule therein.

5. The system of claim 1, wherein said flexible wall member has an outer surface and said outer surface has a connecting means thereon for connecting portions of said flexible wall member together in order to hold said wrapping body in a desired shape.

6. The system of claim 1, wherein said cavity has an elastic impact resistant material compressed and accommodated therein.

7. The system of claim 1, and further comprising an exhaust valve mounted on said wrapping body and communicating with said cavity for exhausting the gas from said cavity to the outside of said cavity.

8. The system of claim 7 herein said exhaust valve further comprises means for reinjecting a gas into said cavity after said cavity has been exhausted and resealing said cavity.

9. The system of claim 1, wherein said gas-generating capsule is provided with means for preventing accidental pressing of said gas-generating capsule in said cavity.

10. The system of claim 1, wherein said gas-generating capsule is located at a predetermined position in said cavity, and said flexible wall member has indicia thereon corresponding to the predetermined position of said gas-generating position.

11. The system of claim 1, wherein said gas-generating capsule comprises one vessel half made of a hard material, another vessel half connected to said one vessel half and comprising said portion permeable to the gas, and a partition film separating said at least two types of materials.

* * * * *